United States Patent [19]

Albinger, Jr.

[11] 4,194,192

[45] Mar. 18, 1980

[54] ALARM DEVICES FOR INTERCONNECTED MULTI-DEVICE SYSTEMS

[75] Inventor: Harry Albinger, Jr., Monroe, Conn.

[73] Assignee: General Electric Company, New York, N.Y.

[21] Appl. No.: 968,514

[22] Filed: Dec. 11, 1978

[51] Int. Cl.[2] ..... G08B 17/10; G08B 23/00; G08B 3/10

[52] U.S. Cl. ..... 340/517; 340/628; 340/629; 340/691; 340/693

[58] Field of Search ..... 340/506, 514, 517, 628, 340/629, 691, 693, 545

[56] References Cited

U.S. PATENT DOCUMENTS

| | | | |
|---|---|---|---|
| 2,789,282 | 4/1957 | Winters | 340/660 |
| 3,133,276 | 5/1964 | Miller et al. | 340/545 |
| 3,284,787 | 11/1966 | Voigt et al. | 340/630 X |
| 3,555,532 | 1/1971 | White et al. | 340/630 |
| 3,636,542 | 1/1972 | Apple | 340/555 |
| 3,811,123 | 5/1974 | Hamm et al. | 340/636 |
| 4,030,086 | 6/1977 | Salem | 340/636 |
| 4,091,363 | 5/1978 | Siegel et al. | 340/629 X |

FOREIGN PATENT DOCUMENTS

| | | | |
|---|---|---|---|
| 1351748 | 5/1974 | United Kingdom | 340/514 |

*Primary Examiner*—John W. Caldwell, Sr.
*Assistant Examiner*—Daniel Myer
*Attorney, Agent, or Firm*—George R. Powers; Carlos Nieves; Leonard J. Platt

[57] ABSTRACT

Alarm devices are provided with circuit means for permitting interconnection of the alarm devices into an alarm system in which each of the alarm devices continually senses for an adverse condition, such as smoke in a smoke detection alarm system, and in which all of the alarm devices signal an alarm in response to the sensing of an adverse condition. The interconnections for the alarm devices are such that the alarm devices not directly coupled to operative sources of electric power will, nevertheless, sense adverse conditions and signal alarms when any one of the alarm devices senses an adverse condition.

9 Claims, 4 Drawing Figures

ALARM DEVICES FOR INTERCONNECTED MULTI-DEVICE SYSTEMS

BACKGROUND OF THE INVENTION

1. Field of the Invention

This invention relates to alarm devices for use in interconnected alarm systems and, more particularly, to alarm devices and systems in which an adverse condition such as smoke sensed by one or more of the devices causes all of the interconnected devices to signal an alarm.

2. Description of Prior Art

Alarm devices such as smoke or intrusion alarm devices are often used to signal the existence of an adverse condition. Such devices are typically self-contained in that the sensing apparatus and the alarm apparatus are combined in a single unit which may be placed wherever required to protect the premises. In the case of smoke detection, it is common to locate a number of smoke alarm devices throughout the premises. For example, in a typical home installation, one unit may be placed in the bedroom area while other units may be located in the living area, the garage, and the basement. If the units are totally self-contained, only the unit sensing an adverse condition will signal an alarm. This is undesirable under certain conditions in that the alarm signalling the alarm may be located where it cannot be seen or heard, e.g., people sleeping in the bedroom area may not be awakened by a horn alarm sounding in the basement area. To overcome this problem, it has been suggested in the past that alarm devices be provided with remote alarms, thereby substantially extending the warning range of the detection equipment. In this respect, a smoke alarm located in a basement area may be provided with an auxiliary alarm in a bedroom area. While this certainly extends the warning range of the detection equipment, it has a disadvantage of adding significantly to the cost of the overall system since it requires multiple alarm devices for detection in a single location. Furthermore, the resulting system is totally disabled in the event that the power supply to the primary unit is disrupted for some reason.

The cost problem can be largely overcome by connecting the individual alarm units in parallel such that an adverse condition sensed by any one of the alarm devices will produce a warning signal on all of the interconnected units that are individually connected to operative sources of electric power. In such systems, however, an alarm device not connected to an operative source of electric power will neither sense for the presence of an adverse condition nor signal an alarm in response to the sensing of an adverse condition by another of the interconnected units. If, for example, in a home installation of a smoke detection system, a detector in a basement detects smoke, an interconnected detector located in the bedroom area will sound an alarm only if the bedroom unit is connected to an operative source of electric power. Similarly, the bedroom unit under such circumstances will not sense for smoke.

SUMMARY OF THE INVENTION

It is therefore a primary object of the invention to provide an improved alarm system for sensing the adverse conditions at a number of locations and for operating all of the alarms in response to the sensing of an adverse condition at only one location.

Another object of the invention is to provide alarm devices which may be used individually or interconnected into an alarm system in which units not directly coupled to operative sources of electric power nevertheless sense for adverse conditions and signal alarms.

Yet another object is to provide alarm devices for use in an interconnected alarm system in which units not directly coupled to operative sources of electric power will nevertheless signal an alarm in response to the sensing of an adverse condition by another of the interconnected alarm devices.

A still further object of the invention is to provide an improved smoke detection alarm system having operating characteristics as set forth by the foregoing statements of objects.

Briefly stated, in carrying out the invention in one form, an alarm device adopted for use in a multidevice alarm system includes terminal means for connection to a source of electric power, an alarm circuit coupled to the terminal means and including a normally conductive alarm means and a normally non-conductive (OFF) switching means connected in series, energy storage means coupled to the terminal means and connected in series with the alarm circuit, control means coupled to both the terminal means and the switching means for sensing an adverse condition and supplying an output signal to the switching means when an adverse condition is sensed. The switching means is selected such that it switches to its conductive state only while an output signal is being supplied to it by the control means. Circuit means are connected to the switching means so as to permit the interconnection of the switching means in parallel with the switching means of other alarm devices. In this manner, a source of electric power connected to at least one interconnected alarm device will charge the energy storage means of all of the interconnected alarm devices. Also in accordance with the invention, each energy storage means has sufficient energy storage capacity to operate the associated alarm means for a discernible period of time. As a result, all of the interconnected alarm devices will operate in response to the sensing of an adverse condition by any one of the interconnected alarm devices.

By a further aspect of the invention, the energy storage means is a capacitor, and the alarm device includes power supply means for converting alternating current electric power to direct current electric power. By still further aspects of the invention, the control means comprises at least one detection element for detecting the presence of combustion and an electronic control circuit for producing the output signal. The switching means is a semi-conductor element, preferably a silicon controlled rectifier (SCR), having a control input connected to the control circuit for receiving output signals therefrom.

BRIEF DESCRIPTION OF THE DRAWINGS

While the novel features of the invention are set forth with particularity in the appended claims, the invention, both as to organization and content, will be better understood and appreciated, along with other objects and features thereof, from the following detailed description taken in connection with the drawings, in which:

DESCRIPTION OF A PREFERRED EMBODIMENT

Figure 1:
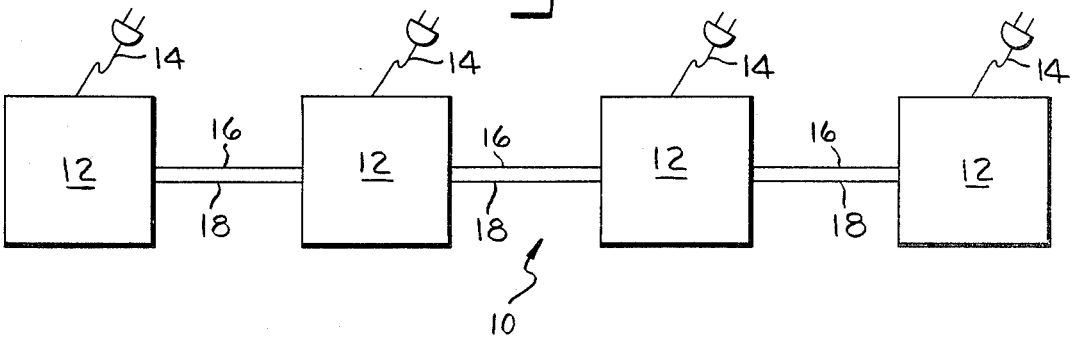
FIG. 1 is a diagrammatic view of an alarm system utilizing the present invention.

Referring first to FIG. 1, an alarm system 10 having four alarm devices 12 interconnected in accordance with the invention is illustrated. Each of the alarm devices 12, which may be a smoke alarm or an intrusion alarm or the like, is provided with a power cord 14 which may be connected to a suitable source of electric power, such as normal house current. The alarm devices 12 are interconnected by leads 16 and 18 in a manner hereinafter described. The function of the leads 16 and 18 is to assure that the entire alarm system 10 remains operative so long as a single one of the alarm devices 12 is operatively connected to a source of electric power. More particularly, this means that each of the alarm devices 12 will provide sensing for an adverse condition, such as smoke, even though only one of the devices is connected to a source of electric power. Furthermore, upon the sensing of the adverse condition by any one of the alarm devices, whether or not it is directly connected to a source of electric power, all of the alarm devices will signal an alarm.

Figure 2:
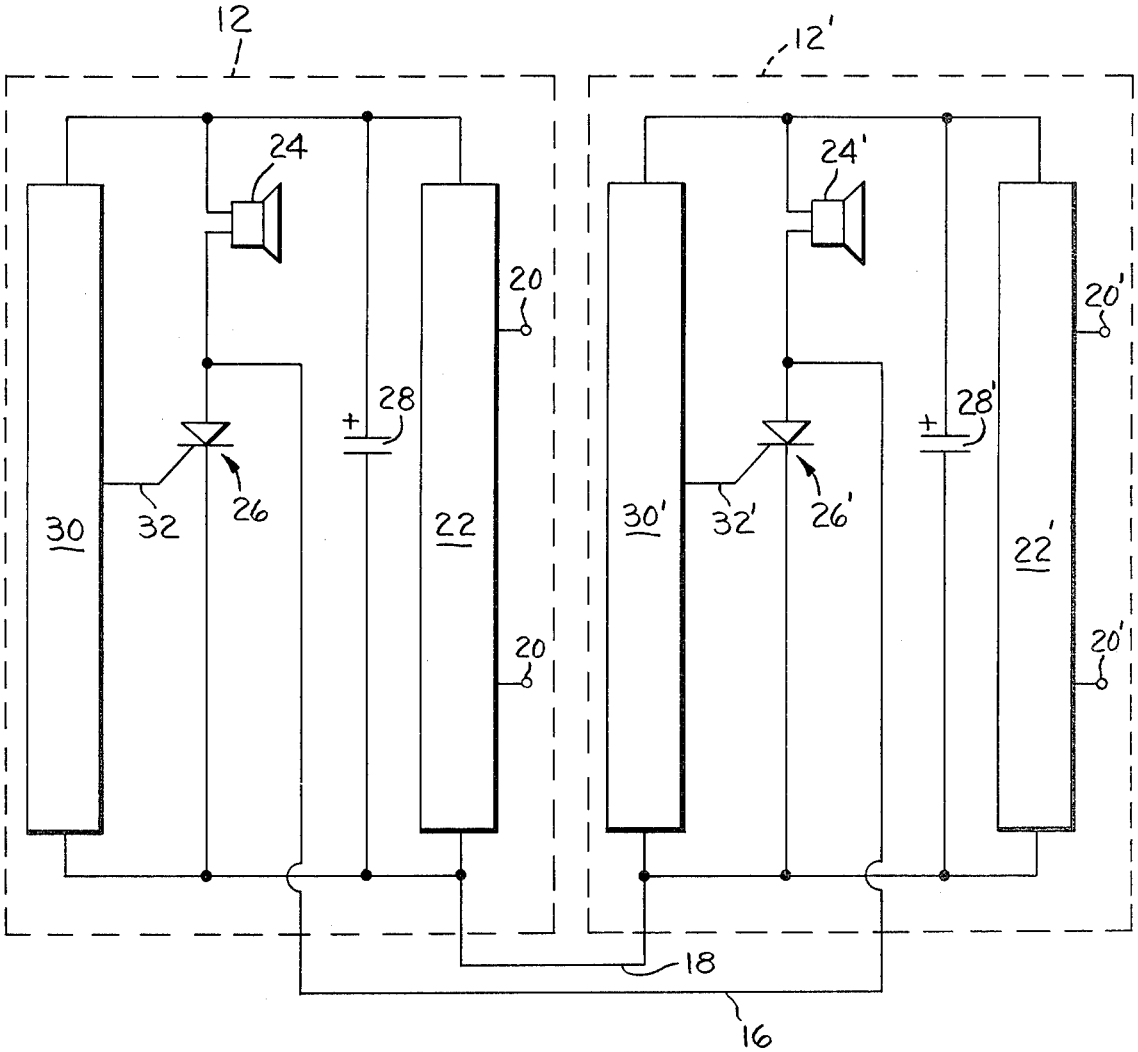
FIG. 2 is a diagrammatic view showing two alarm devices interconnected in accordance with the invention.

Referring now to FIG. 2, two of the alarm devices 12 are disclosed in somewhat greater detail, the second one of the alarm devices and its components being identified by primed numerals for convenience. As illustrated, each of the alarm devices 12 has a pair of terminals 20 through which internal electric power may be supplied to the device. As indicated above, their power is preferably alternating current electric power. The terminals 20 are coupled through a power supply 22, which converts alternating current supplied to the terminals 20 to direct current power, to an alarm circuit comprising a normally conductive horn 24 and a normally non-conductive (OFF) semi-conductor switch 26 preferably a silicon controlled rectified (SCR) as shown. The terminals 20 are additionally coupled to a capacitor 28, which also forms a series circuit with the horn 24 and the switch 26. A control circuit 30 is also coupled to the terminals 20, the function of the control circuit 30 being to sense for an adverse condition, such as smoke, and to produce an output signal on line 32 whenever smoke is sensed. The gate of the SCR 26 is connected to receive output signals over line 32 and to maintain the SCR 26 in its conductive (ON) state so long as an output signal is produced by the control 30.

The general mode of operation of the alarm system 10 will not be described with reference to FIGS. 1 and 2. If each of the power cords 14 is connected to a suitable source of alternating current electric power, the power supply 22 of each device 12 will provide direct current electric power of suitable voltage, such as 10 volts, to the capacitor 28, the alarm circuit comprising the horn 24 and the SCR 26, and the control circuit 30. So long as an adverse condition is not sensed by the control circuit 30 of any one of the units 12, all of the SCR's 26 will remain OFF and no alarm signal will be produced. If, however, circuit 30 of any one of the alarm devices 12 produces an output signal on line 32 indicative of the presence of an adverse condition, the associated SCR 26 will turn ON, thereby closing the alarm circuit of that alarm device and causing its horn 24 to sound. In addition, the horns 24 of each of the other interconnected devices 12 will also sound. This will be better understood from consideration of the two alarm devices 12 and 12' illustrated by FIG. 2. Thus, if the control circuit 30 of the alarm device 12 senses an adverse condition, it will produce an output signal on line 32 and turn ON the SCR 26. The turning ON of the SCR 26 closes the alarm circuit coupled to the terminals 20 through the direct current power supply 22 such that current flows through the alarm circuit so as to sound the horn 24. The turning ON of the SCR 26 also closes a circuit across the output of the power supply 22'. As a result, both the horn 24 and the horn 24' operate with the SCR 26 carrying the total current, SCR 26' remaining OFF. Similarly, the alarms of all of the units 12 of FIG. 1 will sound whenever one units senses an adverse condition, the total alarm current flowing through the SCR 26 of the unit which senses the adverse condition. The SCR's 26 must therefore be selected for the maximum possible current load.

Still referring to FIG. 2, let it now be assumed that alarm device 12' is not being supplied by the power supply 22' with direct current power. This could occur if the terminals 20' are not connected to a suitable source of electric power or if the power supply 22' is for some reason defective or otherwise disabled. In the absence of an adverse condition at both devices 12 and 12', the power supply 22 will charge the capacitor 28' through horn 24, line 16 and horn 24' to a voltage within the normal operating range. Since the capacitor 28' maintains a normal operating voltage, the control circuit 30' will be operative even though the power supply 22' is not operative. If an adverse condition should be sensed by the device 12', an output signal will be produced on line 32' and the SCR 26' will turn ON. When this occurs, the capacitor 28' discharges through the horn 24' and the SCR 26', thereby sounding the horn 24', the control circuit 30' will become inoperative upon discharge of the capacitor 28', the result being the disappearance of the output signal on line 32' (even if the adverse condition continues), the switching OFF of the SCR 26', and the silencing of the horn 24'. In accordance with the invention, it is essential that the energy storage capacity of the capacitors 28 be sufficient to operate the associated alarm 24 for a discernible period of time, say one to two seconds, so that a meaningful warning of an adverse condition will be provided.

If the control circuit 30' senses an adverse condition and turns ON the SCR 26' and the horn 24' for the period of time required to discharge the capacitor 28; the horn 24 of the other alarm device 12 will also sound since, for the time SCR 26' is ON, a circuit will be completed across the output of power supply 22 through the horn 24, line 16, SCR 26', and line 18. As soon as SCR 26' turns OFF, both horns 24' and 24 will stop sounding. As soon as SCR 26' turns OFF, however, the capacitor 28' will again be charged by the power supply 22, and the horn 24 and 24' will thereafter again be sounded (assuming that the control circuit 30' still senses an adverse condition).

Let is now be assumed that only the alarm device 12 of FIG. 2 is connected to an operative source of electric power. As in the previous example, both the device 12 and the device 12' will be capable of sensing for an adverse condition. If, however, it is the powered unit 12 that senses the adverse condition, the operation is somewhat different than that of the previous example in which the adverse condition was sensed by the non-powered unit. If the powered unit senses the adverse condition, an output signal on line 32 will turn ON SCR 26, which will remain ON so long as the adverse condition is sensed by the control circuit 30 (continuously). As a result, the horn 24 will sound continuously since the horn 24 and the SCR 26 from a closed circuit across the power supply 22. When the SCR 26 first turns ON, the capacitor 28' of the device 12' will discharge through the horn 24', line 16, SCR 26, and line 18 to sound the horn 24' for the discernible period of time that it takes to discharge the capacitor 28'. Following discharge, the capacitor 28' will not recharge until the SCR 26 turns OFF. Since the SCR 26 remains ON for the duration of the adverse condition, the horn 24' will therefore sound only one time.

From the foregoing, it will be seen that the entire alarm system 10 will be operative so long as at least one of the alarm devices 12 is connected to an operative source of electric power. The mode of alarm signaling differs somewhat in accordance with the power and sensing characteristics of the system. Specifically, if all units are powered and the adverse condition is sensed by one or more units, all units will produce an alarm signal which continues as long as the adverse condition is sensed. If one or more units are powered and the adverse condition is sensed by a non-powered unit, all units will produce an intermittent alarm signal. If one or more units are powered and the adverse condition is sensed by a powered unit, all of the powered units will produce a continuous alarm signal and all of the non-powered units will produce a single relatively short initial alarm signal.

Figure 3:
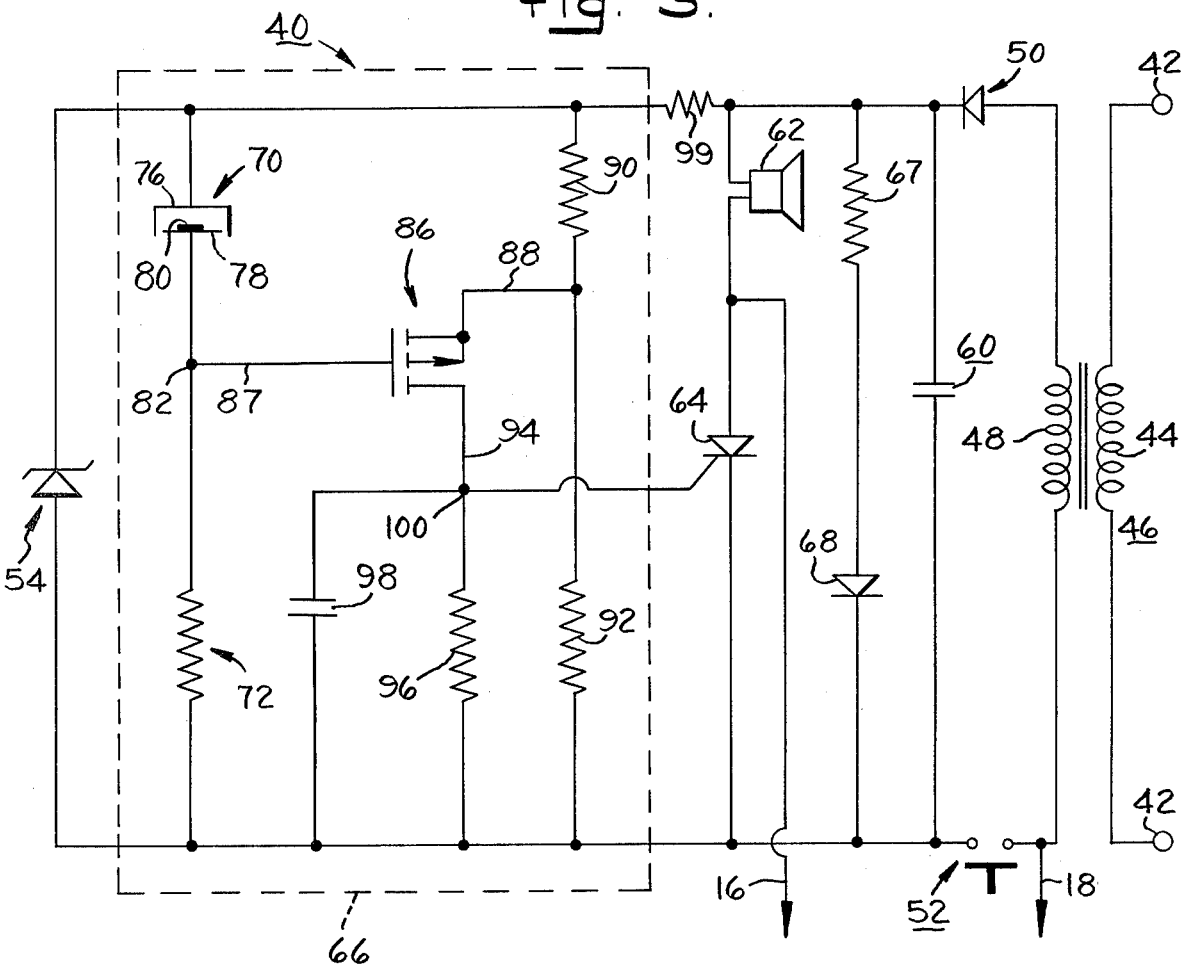
FIG. 3 is a circuit diagram of a smoke detector utilizing the present invention.

Referring now to FIG. 3, a smoke detector 40 incorporating the present invention is illustrated, the smoke detector 40 being capable of operation as a single unit or as an alarm device 12 in an alarm system 10 as illustrated by FIGS. 1 and 2. The smoke detector 40 includes a pair of terminals 42 connected to a direct current power supply comprising a power transformer 46 and a diode 50. The terminals 42 are connected to the primary winding 44 of the transformer 46, and the secondary winding 48 is connected in series with the diode 50 to provide direct current output power when a switch 52 is closed (shown open). If, during normal operation, the switch 52 is opened; the unit 40 will not be operative in accordance with the invention whether or not it is interconnected in an alarm system in which other units are powered. Switch 52, connected to the cover interlock, allows the owner to disconnect a false-alarming unit from the system. By having lead 18 connected intermediate the switch 52 and the secondary winding 48, all interconnected units will be silenced when the switch 52 of the unit that is false-alarming is opened by removing the cover. If the cover of any of the other units is removed, the opening of the associated switch 52 will only silence the unit that is opened. The false-alarming unit and all of the other interconnected units will continue to sound an alarm. In this manner, it is relatively easy to identify and remove a false-alarming unit from the interconnected system. So long as the switches 52 of the other units are not opened, they will continue to operate to detect smoke.

A zener diode 54 is connected across the output of the power supply to maintain a substantially fixed supply voltage, typically 10 volts. In accordance with the previous description of FIGS. 1 and 2, the alarm device 40 includes energy storage means in the form of a capacitor 60 connected across the power supply, an alarm circuit comprising a horn 62 and an SCR 64 connected across the power supply, and a control circuit connected across the power supply, the control circuit being identified by the circuitry enclosed within the outlined block 66. The output of the power supply is also connected across the series circuit comprising a resistor 67 and a light-emitting diode (LED) 68, which glows to indicate a power ON condition where power is being supplied by the power supply; the LED 68 will not glow when the switch 52 is open but will glow when switch 52 is closed and operating power is being supplied by another interconnected smoke alarm.

Referring now to FIG. 3, a smoke detector incorporating the present invention is illustrated, the smoke detector being suitable for use as one of the alarm devices 12. The control circuit 66 includes an ionization chamber 70 and a resistor 72 connected in series across the power supply. The chamber 70 is open to the atmosphere and its interior is thus freely accessible to air and airborne products of combustion or aerosols. For reasons which will become apparent as this description proceeds, the chamber 70 is a measuring chamber and the resistor 72 is a substantially fixed reference.

As illustrated, the measuring chamber 70 includes a pair of spaced-apart electrodes 76 and 78 and a source 80 of alpha radiation such as Americium 241 for ionizing the air in the interior space between the electrodes 76 and 78. An ion current will flow between the electrodes 76 and 78 when a voltage is applied thereacross. If aerosols or products of combustion enter the interior space of the chamber 70, the current flow will be reduced if the voltage across the electrodes is maintained constant. In other words, the introduction of combustion aerosols increases the electrical resistance of the chamber 70, the amount of resistance change being indicative of the amount of combustion products present in the chamber 70. Since the zener diode 54 maintains a fixed voltage and the resistor 72 has a substantially fixed resistance, the introduction of smoke or other products of combustion into the chamber 70 will cause a reduction in the voltage at junction 82.

A MOSFET field effect transistor 86 of the enhancement type has its gate 87 coupled to the junction 82 intermediate the chamber 70 and the resistor 72. The source 88 of the MOSFET 86 is connected to a relative positive voltage through the resistive network comprising resistors 90 and 92, and the drain 94 of the MOSFET 86 is connected to a relative positive voltage through the resistive network comprising resistors 90 and 92, and the drain 94 of the MOSFET 86 is connected through resistor 96 and capacitor 98 to the negative output of the power supply. The drain 94 of the MOSFET 86 is also connected to the gate of the SCR 64 through junction 100.

Figure 4:
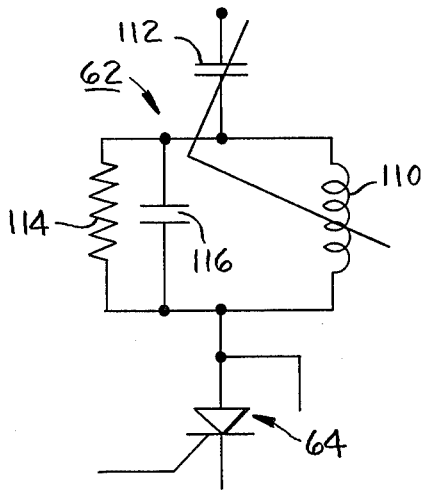
FIG. 4 is a detailed circuit diagram of the normally conductive alarm means of the smoke detector of FIG. 3.

The normally conductive horn 62 is illustrated in more detail by FIG. 4, the horn being represented by a coil 100 in series with the SCR 64 and a pair of normally closed contacts 112 mechanically connected to the horn mechanism for being rapidly opened and closed during sounding of the horn. A resistor 114 and a capacitor 116 are provided in parallel across the horn coil 54 to prevent large inductive spikes, which could damage other circuit components, from being generated by the coil when the horn is sounding.

When there is no smoke or other airborne products of combustion within the measuring chamber 70, the voltage at junction 82 relative to the voltage on the source 88 is less than the threshold voltage of the MOSFET 86.

Since the MOSFET 86 is of the enhancement type, this means that the MOSFET is essentially OFF (not conducting) under these conditions. Since the MOSFET 86 is essentially OFF, there is substantially no current flow through the resistor 96 and the junction 100 is maintained at a voltage substantially identical to that of the negative output of the power supply. As a result, the SCR 64 is also maintained in its OFF or non-conductive condition, and the horn 62 is not sounded.

If smoke or other combustion products enter the chamber 70, the voltage across the chamber 70 and the source-to-gate voltage of the MOSFET 86 will increase and progressively turn on the MOSFET 86. Once the MOSFET 86 reaches a preselected conduction level, current flow through the resistor 96 causes the voltage at junction 100 to increase sufficiently to turn on the SCR 64 and sound the horn 62. The horns of any smoke detectors interconnected by lines 16 and 18 will also be turned on in the manner described above. If the smoke level in the chamber 70 subsequently drops below the preselected trigger point, the voltage at the junction 82 will rise, and the source-to-gate voltage on the MOSFET 86 will therefore fall below the level required to maintain the preselected level of conduction through the MOSFET 86 and the resistor 96. This means that the voltage at junction 100 will also fall and the SCR 64 will turn OFF when its current falls below its holding level (due to periodic opening during horn operation of the normally closed contacts 120). This in turn will cause the horn 62 and any interconnected horns to turn off.

It will be noted that the smoke detector 40 is capable of functioning as an individual smoke detector not connected to any other alarm device. To function as an individual unit, the terminals 42 must, of course, be connected to a suitable source of electric power. Alternatively, the lines 16 and 18 of two or more units may be interconnected into an alarm system as described above with respect to FIGS. 1 and 2. In this latter case, one or more of the detectors must be connected to a source of electric power in order for all of the interconnected units to function in the manner described above.

As described herein, the terminals 42 of the smoke detectors 40 are adapted to be connected to a source of alternating current electric power, the power supply including the power transformer 46 and the diode 50 converting the alternating current input into a lower voltage direct current output. It would, of course, be possible to eliminate the power supply, connecting the terminals 42 to a direct current source such as a battery. When interconnected into an alarm system, however, such an arrangement would not be entirely satisfactory under all conditions since the life of all of the batteries would be tied to the life of the weakest battery in the system. For this reason, it may be desirable to interconnect battery-operated alarm devices in the manner disclosed and claimed by copending patent application Ser. No. 968,426 entitled "Alarm Devices for Interconnected Multi-Device Systems", filed on Dec. 11, 1978, and assigned to the assigned hereof, General Electric Company.

Smoke detectors having the circuitry of FIGS. 3 and 4 have been built and successfully operated in interconnected alarm systems. These smoke detectors 40 include a measuring chamber 70 having a 2 microcurie source of Americium 241, a Phillips BZX79010 zener diode 54 providing a voltage of 10 volts, a special MOSFET 86, a GEC103B SCR 64, and a capacitor 60 having an energy storage capacity of 330 microfarads, with a 0.04 microfarad capacitor 116 and a resistor 114 having a resistance of 1,000 ohms and the diode 50 is an A14A rectifier. The resistance values of the resistors are as follows: 72–100,000 megohms; 96–15,000 ohms; 90 and 92–5,000 ohm potentiometer; 67–1,500 ohms; 99–470 ohms; and the LED 68 is a XCITON SC111. It has been found that as many as ten smoke detectors may be interconnected with above components such that all alarms sound when smoke is detected by a single detector. Under such conditions, the SCR 64 of the unit sensing smoke must carry currents of up to 2.5 amps during start-up and up to 0.6 amps during steady-state alarm conditions.

From the foregoing, it will be seen that this invention provides alarm devices which may be used individually or interconnected into an alarm system in which units not directly coupled to operative sources of electric power nevertheless (1) sense for adverse conditions and signal alarms and (2) signal an alarm when an adverse condition is sensed by another unit.

While the invention has been particularly shown and described with reference to a preferred embodiment thereof, it will be understood by those skilled in the art that various changes in form, details, and application may be made therein without departing from the spirit and scope of the invention. Accordingly, it is intended that all such modifications and changes be included within the scope of the appended claims.

What is claimed as new and is desired to secure by Letters Patent of the United States is:

1. An alarm device adapted for use in a multidevice alarm system, said alarm device comprising:

terminal means for connection to a source of electric power;

an alarm circuit coupled to said terminal means, said alarm circuit comprising normally conductive alarm means connected in series with normally non-conductive (OFF) switching means;

energy storage means coupled to said terminal means, said energy storage means connected in series with said alarm circuit and said energy storage means having sufficient electrical energy storage capacity to operate said alarm means for a discernable period of time;

control means coupled to said terminal means and said switching means for sensing an adverse condition and supplying an output signal to said switching means in response thereto, said switching means switching to a conductive state (ON) only while an output signal is supplied thereto; and circuit means connected to said switching means for permitting the interconnection of said switching means in parallel with the switching means of one or more other alarm devices such that a source of electric power connected to the terminal means of at least one interconnected alarm device will charge the energy storage means of all of the interconnected alarm devices, whereby the alarm means of all of the interconnected alarm devices will operate in response to the sensing of an adverse condition by any one of the inter-connected alarm devices.

2. An alarm device as defined in claim 1 in which said energy storage means comprises a capacitor, said alarm device further comprising power supply means coupled between said terminal means and said alarm circuit, said energy storage means, and said control means for converting alternating current electric power to direct current electric power.

3. An alarm device as defined by claim 1 in which said control means comprises at least one detection element for detecting the presence of combustion and an electronic circuit for producing an output signal when combustion is detected, and in which said switching means comprises a semi-conductor switching element having a control input coupled to said electronic circuit for receiving output signals therefrom.

4. An alarm device as defined by claim 3 in which said semi-conductor switching element is a silicon-controlled rectifier (SCR).

5. An alarm device as defined by claim 4 in which said energy storage means comprises a capacitor, said alarm device further comprising power supply means coupled between said terminal means and said alarm circuit, said energy storage means, and said control means for converting alternating current electric power to direct current electric power.

6. An alarm device as defined by claim 1 in which said circuit means comprises a pair of output lines for interconnection to one or more other alarm devices, said circuit means further comprising a normally closed interlock switch connected in series with said switching means intermediate said output lines, whereby opening of said normally closed interlock switch will prevent operation of the alarm device.

7. An alarm system comprising:

a plurality of alarm devices each comprising:

terminal means for connection to a source of electric power;

an alarm circuit coupled to said terminal means, said alarm circuit comprising normally conductive alarm means connected in series with normally non-conductive (OFF) switching means;

energy storage means coupled to said terminal means, said energy storage means connected in series with said alarm circuit and said energy storage means having sufficient electrical energy storage capacity to operate said alarm means for a discernible period of time; and control means coupled to said terminal means and said switching means for sensing an adverse condition and supplying an output signal to said switching means in response thereto, said switching means switching to a conductive state (ON) only while an output signal is supplied thereto; and means interconnecting all of said switching means in parallel such that a source of electric power connected to the terminal means of at least one of said alarm devices will charge the energy storage means of all of said alarm devices;

whereby the alarm means of all of said alarm devices will operate in response to the sensing of an adverse condition by any one of said alarm devices.

8. An alarm system as defined by claim 7 in which the energy storage means of each of said alarm devices comprises a capacitor, each of said alarm devices further comprising power supply means coupled between said terminal means and said alarm circuit, said energy storage means, and said control means for converting alternating current electric power to direct current electric power.

9. An alarm system as defined by claim 8 in which the control means of each of said alarm devices comprises at least one detection element for detecting the presence of combustion and an electronic circuit for producing an output signal when combustion is detected, and in which said switching means comprises a silicon-controlled rectifier (SCR), having a control input coupled to said electronic circuit for receiving output signals therefrom.

* * * * *